US005509254A

United States Patent [19]

Ullrich

[11] Patent Number: 5,509,254

[45] Date of Patent: Apr. 23, 1996

[54] METHOD FOR PACKAGING FLOWERS

[75] Inventor: Peter F. Ullrich, Coral Gables, Fla.

[73] Assignee: Hilsea Investments, Limited, Ecuador

[21] Appl. No.: 238,650

[22] Filed: May 5, 1994

[51] Int. Cl.[6] ..... B65B 11/56; B65B 67/08; B65D 85/50

[52] U.S. Cl. ..... 53/449; 53/216; 53/219; 53/461; 53/390; 206/423

[58] Field of Search ..... 53/465, 461, 430, 53/116, 397, 390, 216, 219, 218, 210, 591, 449, 176, 170, 148, 157, 156, 139.5, 472, 431, 593, 592; 206/423

[56] References Cited

U.S. PATENT DOCUMENTS

| | | | |
|---|---|---|---|
| 2,033,627 | 3/1936 | Gardner | 206/423 X |
| 3,271,922 | 9/1966 | Wallerstein et al. | 206/423 X |
| 3,376,666 | 4/1968 | Leonard | 47/41 |
| 3,657,840 | 4/1972 | Benoist | 206/423 |
| 3,924,354 | 12/1975 | Gregoire | 206/423 X |
| 4,972,627 | 11/1990 | Hori et al. | 206/423 X |
| 5,242,052 | 9/1993 | Weder | 206/423 |
| 5,311,992 | 5/1994 | Weder et al. | 206/423 |

FOREIGN PATENT DOCUMENTS

| | | | |
|---|---|---|---|
| 2-282082 | 11/1990 | Japan | 206/423 |
| 4-128163 | 4/1992 | Japan | 206/423 |
| 2179025 | 2/1987 | United Kingdom | 206/423 |

*Primary Examiner*—James F. Coan
*Attorney, Agent, or Firm*—Lieberman & Nowak

[57] ABSTRACT

Method for packaging flowers which protects against botrytis and the damage inflicted to flowers by shifting during transportation. The method includes wrapping the flower heads in cardboard and plastic and placing the cardboard flush against the ends of a flower box in order to ensure no shifting occurs.

20 Claims, 5 Drawing Sheets

METHOD FOR PACKAGING FLOWERS

BACKGROUND OF THE INVENTION

This invention relates to a method for packaging flowers.

The fresh cut flower industry faces a number of problems in the transport of flowers to their final destination. Two main obstacles are the fragility of the flowers and the disease botrytis.

The main challenge facing the flower industry is to transport fragile, fresh cut flowers while avoiding flower breakage and bruising. Transportation from the grower's farm to the retail market involves many steps. In addition, it is required to transport the flowers to market as quickly as possible in order to be able to offer the freshest flowers available since these are the most desired. In a typical scenario, fresh cut flowers are boxed, transported from the grower's farm in one country to an importer in another country, and finally transported to the retail market. This trip requires much handling and almost constant movement. Constant movement during transportation can cause the flowers to shift and come into contact with the inside of the boxes, resulting in bruised or broken flower heads, torn petals and other damage. The flower head is that part of the flower which consists of the calyx, petals and reproductive organs. Bruising results in the discoloration of petals and/or the calyx and destroys the commercial value of the flowers.

The first step in this typical scenario trip is the precooling of the flowers. The flowers, wrapped in plastic and placed in boxes (as will be described below) are put into a pre-cooler where the flower temperature is quickly lowered to approximately 33° C. by moving cold air over the flowers.

The precooling step is required to lower the temperature of the flowers sufficiently so that they may be efficiently stored in a regular cooler. Placing very warm flowers in a cooler stresses the cooling capacity of the cooler and causes fluctuations in the temperature of the flowers stored in the cooler. Temperature fluctuation can promote the botrytis fungus, as will be discussed below. The storage cooler is kept at a constant 33° C. temperature and 93% humidity to enhance the longevity of the flowers.

Once the flowers are cooled, the flower boxes are then transported in refrigerated trucks from the grower's farm to the airport. There the boxes are kept in cooler facilities in order to maintain temperature and humidity. The boxes are then moved from the airport cooler to the plane which transports the flowers to the country of destination. Upon arrival at the destination airport, the boxes are removed from the plane into the airport's cooler facilities and then removed to undergo inspection in scanning machines. Upon final inspection, the boxes are trucked from the airport to the importer's warehouse in refrigerated trucks and precooled again to the temperature specified above. The flowers are stored in regular coolers at the importer's warehouse. Once sold, the flowers are trucked by the transportation company of the wholesaler's choice to the warehouse facility of the wholesaler, stored, cooled, sold and sent on to the retail market. In summary the typical transportation scenario of fresh cut flowers entails the coverage of long distances and many transfers from carrier to carrier in a short period of time. The constant movement and handling exposes the flowers to the possibility of breakage and/or bruising.

A second challenge to the industry is the disease botrytis. Botrytis is a disease caused by an airborne fungus, botrytis cinerea. It lives on moist plant tissue such as old leaves, blooms and debris. The fungus produces spores that are carried through the air on water. In conditions of high humidity, botrytis spores attack and damage young, soft, succulent plant tissue and is manifested as rot.

The best way to control botrytis is to make conditions less favorable for its growth and development. One method of control is to hold the relative humidity below the dew point, the point at which the level of relative humidity causes condensation of water from the atmosphere. On plant and vegetation, this condensed water is known as dew.

Lowering the relative humidity will reduce the number of botrytis infections. This is usually done by ventilating the greenhouse on dry days or ventilating while heating on very humid days.

However, during the transport of fresh cut flowers the environment is not so easily controlled as that in a greenhouse. The movement of flower boxes in and out of various coolers during transportation, as described above, generates fluctuating temperatures, causing condensation to occur on flowers. Since the spores are carried in the air and flower boxes have open flaps, it is easy for the botrytis spore to find a home on flowers during transportation.

The current industry method of packaging results in flower heads being wrapped in a sausage-like manner in a plastic wrapper. In that method, a rectangular piece of microperforated plastic is laid lengthwise. Starting at one of the short ends of the plastic wrap, the packer lays a first flower on top of the plastic. The second flower is positioned adjacent to the first. Once the plastic is covered with the flowers, it is wrapped around the flowers and taped to keep the bunch from unrolling.

One problem with this method is that the flower heads are in contact with each other, thereby increasing the possibility of head breakage and bruising. Also, the wrapped flower bunches can shift during transport, causing the fragile flower heads to contact the shipping box and become bruised.

The plastic wrap currently used serves two purposes. First, since it is microperforated, it allows moisture to evaporate and the heads of the flowers to breathe, thereby minimizing the possibility of botrytis developing. Second, to a limited extent, the plastic wrap also protects the flower heads in case shifting occurs during transportation.

After the flowers are wrapped in plastic, the bunches are then boxed. The flower boxes are lined with paper and the wrapped bunches are placed in the box using a cross packing method. In the cross packing method the bunch is placed lengthwise in the box in such a manner that all the heads are more than two inches from the short side of the flower box. The second bunch is placed in the same manner but faces the opposite short side of the box. Upon completion of the first layer of bunches, a paper lining is placed for the protection of the first layer. A second layer of bunches is placed on top of the paper lining using the same cross packing method.

Upon completion of this second layer, a paper lining is placed over the bunches for additional protection. The box is then cleated. A cleat is a wooden stick which has a breadth and depth of approximately ¾ inch and length of approximately the same as the width of the box being used.

Cleats are inserted at the midpoint of the box and placed directly over and contacting the stems of the flowers. The cleat is nailed in from the outside to hold it in place. The purpose of the cleat is to prevent movement of bunches against the ends of the box during transportation.

In larger boxes of flowers, when up to three layers of bunches of flowers can be packed, a cleat is necessary after the first and third layers of wrapped flowers.

There are many problems caused by the presence of cleats in the flower box. First, the cleats may cause damage to the stems of the flowers by rubbing against the stems and the cleat may loosen within the box causing the flowers to shift.

Second, the clearing step is very labor intensive and therefore adds significant cost to the packaging. It is very difficult for the person clearing the box to place the cleats correctly and avoid damaging the flowers.

Further, at the wholesale end, it is very difficult to remove the cleats while unpacking the flowers and a certain percentage of flowers may be damaged during the removal of the cleats.

The transportation of flowers from the grower's farm to the retail level entails constant handling and movement, resulting in shifting of the flowers and damage to the fragile heads. While creating is an attempt to solve this problem, it is expensive, inconvenient and not always effective.

SUMMARY OF THE INVENTION

The inventive packaging concept overcomes the two main problems in the current method of packaging flowers, i.e., in-transit flower damage and aids in the control of botrytis.

An object of the invention is to give better protection against bruising and breakage of flowers during transportation.

A related object of the invention is to eliminate the cleating step necessary in the current packaging of flowers.

Another object of the inventive method is to aid in the control of botrytis development.

DESCRIPTION OF THE PREFIGURED EMBODIMENTS

While the invention will be described in connection with a preferred embodiment, this embodiment is merely illustrative and is not intended to limit, and should not be construed to limit, the invention in any way. On the contrary, the invention covers all alternatives, modifications and equivalents as may be included within the spirit and scope of the invention as defined by the appended claims.

According to the inventive method, the fragile flower heads are wrapped in a cardboard wrap to form a bunch in which the cardboard protects the heads against bruising, while eliminating the clearing step of the method currently used. The cardboard is stiff enough to absorb the force of the bunch contacting the flower box when shifting occurs and preventing the fragile flower heads from ever contacting the box. The cardboard should also be flexible enough to enable the packer to roll around the flowers. The cardboard is preferably an absorbent material in order to absorb water from the heads of the flowers to help control botrytis.

Figure 1:
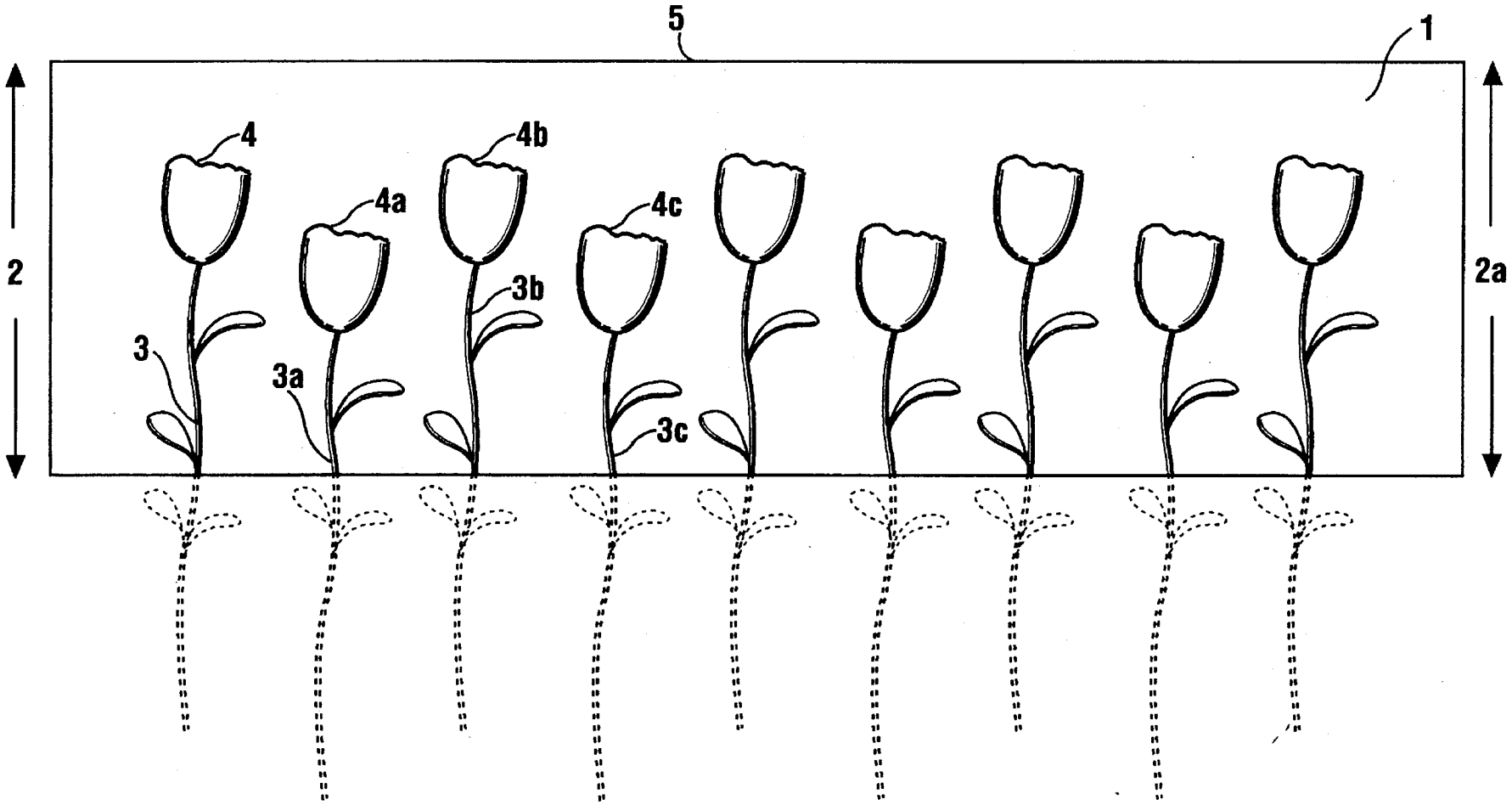
FIG. 1 illustrates the step in the inventive method for wrapping the flowers in cardboard.

FIG. 1 illustrates the first step of the inventive method for packaging flowers. First, a rectangular piece of cardboard material 1 is laid lengthwise. Starting at one of the short sides 2 of the cardboard 1, the packer places the first flower 3, positioning the head 4 five (5) cm below the top 5 of the cardboard 1. The second flower 3*a* is positioned adjacent to the first flower 3. The top of the head 4*a* of the second flower 3*a* is lined up with the bottom of the head 4 of the first flower 3. The positioning of the remaining flowers (3*b*, etc.) follows this staggered format.

Figure 2:
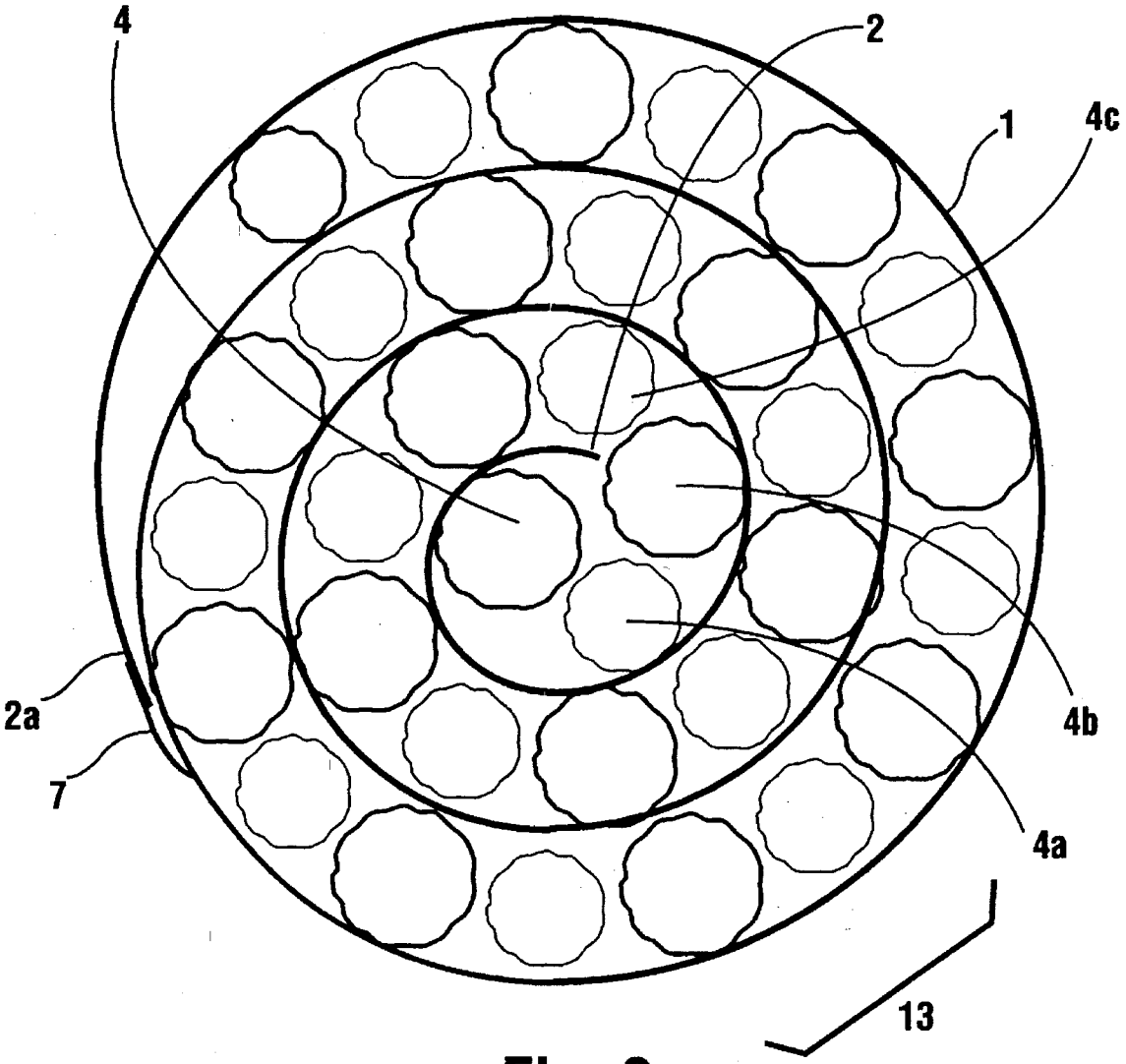
FIG. 2 is an overview of a bunch of flowers wrapped in the inventive method.

Once all the flowers 3 are placed on the cardboard 1, the packer, starting at one of the short ends 2, carefully and firmly rolls up the cardboard material 1. FIG. 2 is an overview of the bunch of flowers 13 after they have been rolled up in the cardboard 1. Upon completion of the rolling step, the open short end 2*a* of the cardboard 1 is fixed with tape 7 to the side of the cardboard 1 to keep the bunch 13 from unrolling.

As illustrated in FIG. 2, as viewed from above, the rolling of the cardboard results in a spiral effect. The flower heads 4, are protected from one another by the cardboard 1 and the fact that the successive flower heads 4, 4*a*, 4*b*, 4*c*, etc. cannot come into contact with each other. This is accomplished by the step described previously and illustrated in FIG. 1 in which the flower heads are placed adjacent to each other, but staggered to vary the distance of the heads from the top of the cardboard.

Figure 3:
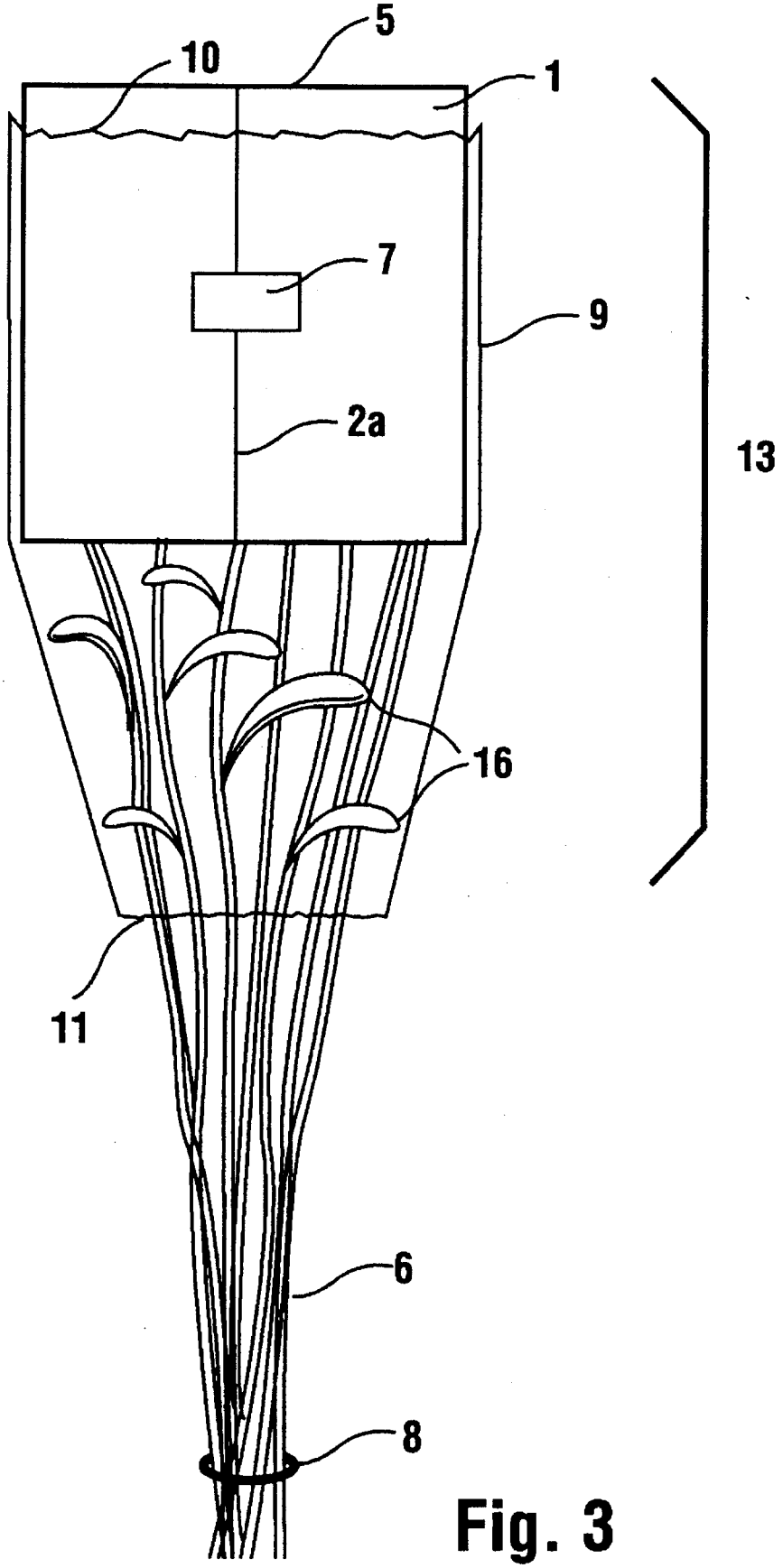
FIG. 3 is a side view of a bunch of flowers wrapped in the inventive method.

FIG. 3 is a side view of the flower bunch 13 as wrapped. The stems 6 on this rolled bunch are tied together at the bottom with an elastic band 8. The cardboard 1 is covered with a plastic or equivalent wrap 9. A preferred embodiment of the plastic wrap is a clear, bi-oriented polypropylene wrap. A more preferred embodiment of the plastic wrap is a breathable material. Another preferred embodiment is a microperforated plastic wrap. The biorientation of the plastic wrap results in a tapered configuration when wrapped around the flowers. The top of this plastic wrap 10 covers the cardboard but does not extend beyond the top 5 of the cardboard 1. The bottom of the wrap 11 is tapered and extends below the cardboard 1 to cover the leaves 16. Paper (not shown) is wrapped over the leaves 16 and stems 6 of this bunch for protection.

Figure 4:
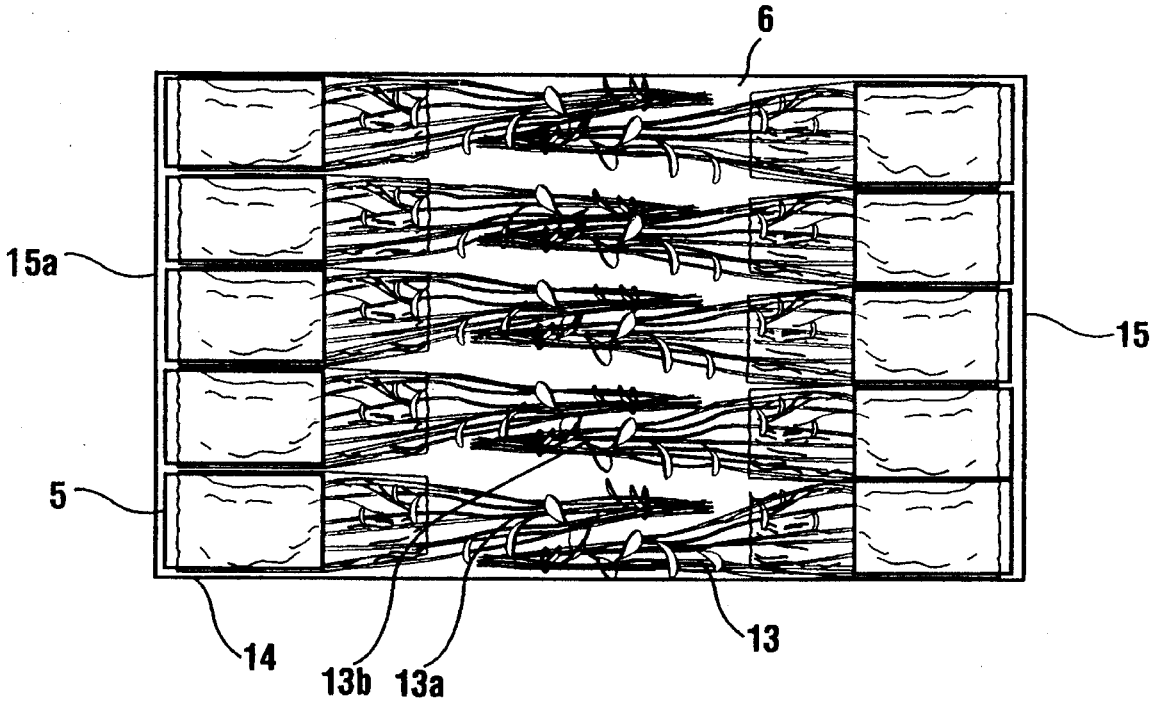
FIG. 4 illustrates the inventive flower packaging.

FIG. 4 illustrates how the wrapped bunches 13 are placed in flower boxes 14. The flower boxes 14 come in various sizes and accommodate different stem lengths and number of flower bunches per box.

The flower box 14 is lined with paper (not shown) and the first bunch 13 is placed lengthwise in the box 14 in such a manner that the top 5 of the cardboard wrap 1 is laid flushed against one of the short ends 15 of the box. In this placement, the stems 6 will cross the mid-point of the length of the box. The second bunch 13*a* is placed in the same manner but faces the opposite short side 15*a* of the box. The cardboard 1 covering the flower heads will always be laid flushed against the short sides 15 and 15*a* of the box 14. Upon completion of the layer of bunches, a paper lining (not shown) is placed on top of the bunches for protection.

When the box is fully packed, the box cover is placed on, and the box is strapped closed.

The cardboard 1 serves two purposes. First, it protects the flower heads 4 from shifting during transportation. This is accomplished by ensuring that the cardboard 1 lays flush against the short ends 15, 15*a* of the flower box 14 and will prevent the heads 4 themselves from ever contacting the box 14. The cardboard 1 ensures that the flowers arrive at the final destination with minimum losses, i.e. broken heads, bruised and/or torn petals, etc. In contrast, in the method currently used by the flower industry, the flower heads 4 are only protected in a limited way by the plastic wrap, and are directly adjacent to the short end of the flower box. In order to compensate for this, the box must be cleated as described above. Shifting during transportation will cause the fragile flower heads to directly contact the short end of the box, causing bruising or other damage to the flower head.

The clearing step is eliminated by the use of the cardboard 1.

The cardboard 1 also helps to avoid botrytis by absorbing the condensed moisture which has settled on the flower heads. This removes the water necessary for the growth of the botrytis fungus as described above.

The plastic wrap 9 serves three purposes. First, the preferred embodiment, a breathable material, facilitates the breathing process of the flowers, thus enabling the evaporation of the water necessary for the growth of botrytis.

Second, it interacts with the cardboard wrap to constitute an easy and pleasing display method for the flowers. Once the flowers arrive at their final destination and are unpacked from the box, the cardboard 1 is pulled out from the top of the bunch without interfering with the plastic wrap 9. Once the cardboard 1 is removed, the plastic wrap 9 provides the necessary support for the flowers in that bunch. The stems 6 are grasped firmly in one hand and the top 5 of the cardboard is grasped in the other hand. By merely pulling the cardboard 1 directly up away from the flowers, the cardboard will slide off and out easily, leaving the flowers in the plastic wrap 9.

Figure 5:
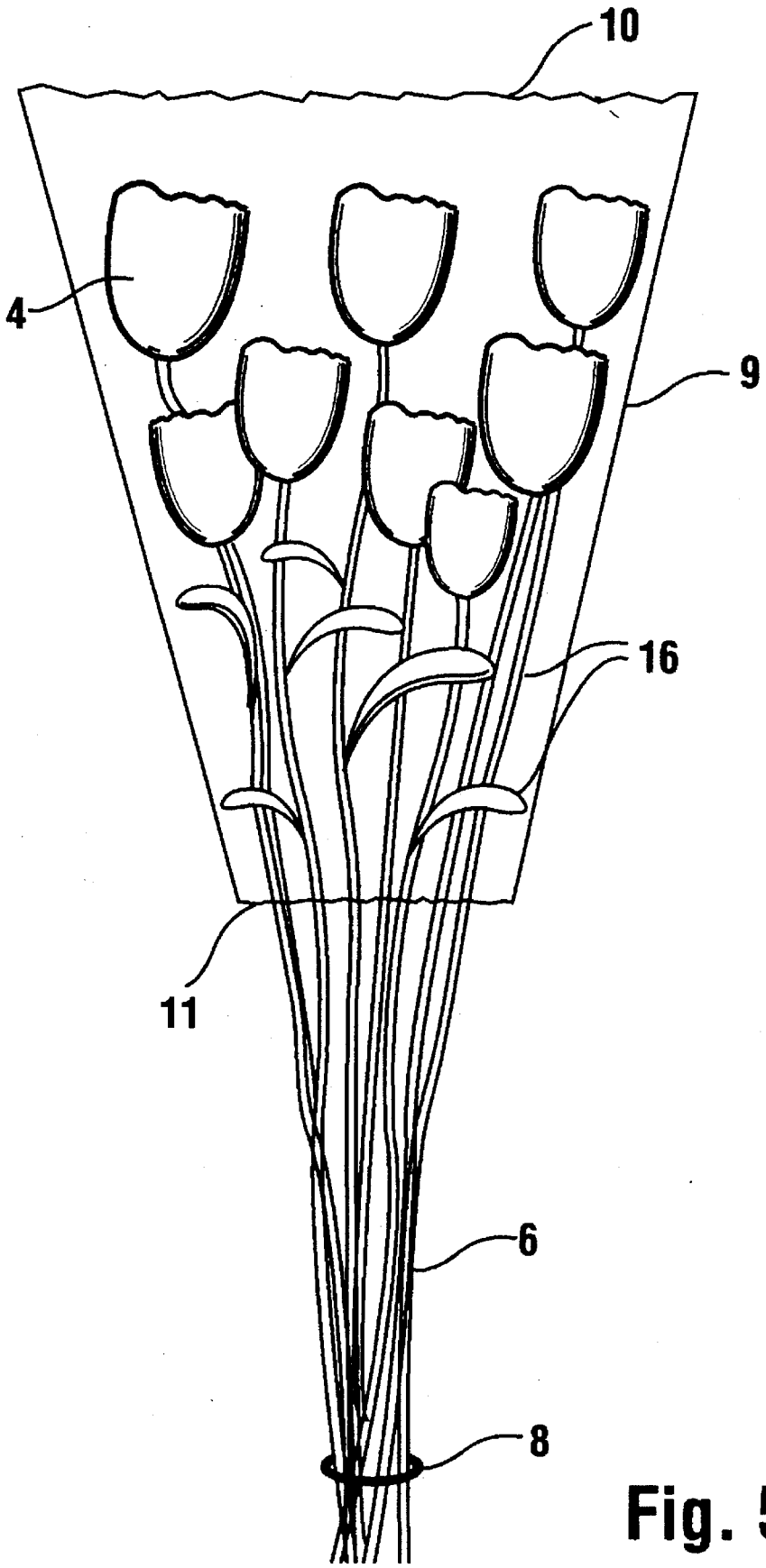
FIG. 5 illustrates the display of flowers after the cardboard wrapping has been removed.

FIG. 5 illustrates the flower bunch in its display form, after the cardboard wrap has been removed. The plastic wrap 9 allows the flowers to expand and provides an easy display form for the wholesaler. This form of display enables the wholesalers and their customers to properly inspect the flowers with minimal human contact. As a result, the possibility of flower head bruising and petal tearing is minimized. It will be apparent to one skilled in the art that various modifications and equivalents may be employed in practicing this invention. No limitations are to be inferred or implied except as specifically set forth in the claims.

I claim:

1. A method for protecting flowers during transport which comprises:

(a) placing the flowers on a protective wrap suitable for rolling in an arrangement wherein the heads of said flowers are placed below the top edge of the wrap and in a manner so that no two adjacent flower heads are the same distance from the top edge of the wrap; and (b) rolling the protective wrap and the flowers so as to form a bunch suitable for transport.

2. The method of claim 1, wherein said arrangement is a staggered formation.

3. The method of claim 1 wherein said protective wrap is an absorbent material.

4. The method of claim 1 wherein said protective wrap is cardboard.

5. A method of claim 1 wherein the flower heads are placed at a predetermined distance or greater from the top edge of the wrap.

6. The method of claim 5 wherein the pre-determined distance is at least 5 cm.

7. A method of claim 5 further comprising placing the bunch into a flower transport box in a manner so that the top edge of the wrap prevents contact between the flower heads and the box or a liner of the box.

8. The method of claim 7 wherein said protective wrap is an absorbent material.

9. A method of claim 1 wherein the rolled protective wrap and flowers form a spiral in which no flower head touches another flower head.

10. A method of claim 1 wherein the rolled protective wrap and flowers in the bunch are arranged so that the protective wrap may be separated from the flowers while maintaining the flowers in a rolled condition.

11. A method of controlling disease development on flowers during transport or storage which comprises wrapping at least a portion of each flower head in an absorbent material.

12. The method of claim 11 wherein said disease is botrytis.

13. The method of claim 11 wherein said wrap is cardboard.

14. The method of claim 11 wherein a predetermined portion of said absorbent wrap is wrapped with a plastic wrap.

15. The method of claim 14 wherein said plastic wrap is made of a breathable material.

16. The method of claim 14 wherein said plastic wrap is microperforated.

17. A method for protecting flowers during transport which comprises:

(a) placing the flowers on a protective wrap suitable for rolling in a staggered arrangement wherein said flower heads are placed in an alternating manner at either a first pre-determined distance from the top edge of the wrap or a second pre-determined distance from the top edge of the protective wrap so as to prevent the heads from contacting one another when the wrap is rolled; and (b) rolling the protective wrap and the flowers so as to form a substantially spiral bunch suitable for transport.

18. A method of claim 17 further comprising placing the bunch into a flower transport box in a manner so that the top edge of the wrap prevents contact between the flower heads and the box or a liner of the box.

19. A method of controlling disease development on flowers during transport or storage which comprises wrapping at least a portion of each flower head in an absorbent material, wherein a predetermined portion of said absorbent material is wrapped with a breathable plastic wrap.

20. A method of controlling disease development on flowers during transport or storage which comprises wrapping at least a portion of each flower head in an absorbent material, wherein a predetermined portion of said absorbent material is wrapped with a microperforated plastic wrap.

* * * * *